United States Patent [19]

Gregory

[11] Patent Number: 4,969,764

[45] Date of Patent: Nov. 13, 1990

[54] CAPLESS RETRACTABLE MARKING PEN

[76] Inventor: Allen R. Gregory, 2708 Wyoming Ave., Norfolk, Va. 23513

[21] Appl. No.: 493,621

[22] Filed: Mar. 15, 1990

[51] Int. Cl.[5] ..... B43K 9/00

[52] U.S. Cl. ..... 401/108; 401/107

[58] Field of Search ..... 401/107, 108, 59, 67

[56] References Cited

U.S. PATENT DOCUMENTS

| | | | |
|---|---|---|---|
| 2,626,592 | 1/1953 | Hedler | 401/67 |
| 2,874,679 | 2/1959 | Zepelovitch | 401/107 X |
| 3,525,573 | 8/1970 | Fend | 401/108 |
| 4,540,300 | 9/1985 | Midorikawa | 401/107 |
| 4,618,280 | 10/1986 | Kageyama | 401/108 |
| 4,711,592 | 12/1987 | Gregory | 401/107 |

*Primary Examiner*—Richard J. Johnson

*Attorney, Agent, or Firm*—Norman B. Rainer

[57] ABSTRACT

An improvement is provided for a retractable tip marking pen whereby the tip, in its retracted position, is enclosed in a chamber which prevents drying of the marking fluid. The chamber is provided by an elastomeric sealing member positioned within the outer sheath of the pen adjacent the lower extremity thereof. The sealing member automatically opens when the tip is pushed to its writing position, and closes when the tip is retracted to its stored position.

3 Claims, 1 Drawing Sheet

CAPLESS RETRACTABLE MARKING PEN

This invention is the subject of Disclosure Document 219590 dated Feb. 8, 1989.

BACKGROUND OF THE INVENTION

This invention relates to pens which utilize a fluid ink an whose writing tips are axially positionable with respect to an outer sheath.

Various types of pens using an aqueous or non-aqueous fluid are in widespread use for writing, drawing, painting or marking purposes, and may collectively be referred to as marking pens. Said fluids, which may be inks having soluble dyes, or paints having dispersed pigments, may be generically referred to as marking fluids. Many of such pens are provided with protective caps which prevent evaporation of the fluid and prevent accidental contact of the fluid with the clothing or skin of the user or with other objects. However, the placement and removal of the cap is troublesome, and the cap is frequently misplaced.

Marking pens which avoid the need for a protective cap are well known and generally employ a mechanism whereby the tip of the pen can be retracted into a protective enclosure within an elongated sheath comprising the outer body of the pen. Marking pens of such construction are disclosed for example in U.S. Pat. Nos. 4,218,154; 3,652,172; and 4,540,300. The protective enclosures and associated retracting mechanisms are, however, generally of complex, expensive construction and do not endure long term use.

A significantly improved retractable tip marking pen is disclosed in U.S. Pat. No. 4,711,592 wherein the tip, in its retracted position, is enclosed within a chamber that prevents drying of the marking fluid. The chamber is fashioned within an elastomeric sealing member positioned within the outer sheath of the pen adjacent the lower extremity thereof. When the writing mechanism within the sheath is pushed downwardly to its writing position, it carries the sealing member, causing it to open and permit axial emergence of the tip.

The means disclosed in U.S. Pat. No. 4,711,592 whereby the writing mechanism carries the sealing member downwardly is an annular activating shoulder which fits into a retaining groove within the sealing member. Careful study of such construction has shown that repeated interaction between the activating shoulder and the sealing member results in stretching, wearing and deformation of the elastomeric material comprising the sealing member. Such factors degrade the seal that is formed when the activating shoulder is seated within the retaining groove. Such factors also cause the activating shoulder to exit the retaining groove before the sealing member reaches its lowermost, open position. Such premature disengagement causes ink to be undesirably deposited upon the lowermost portion of the sealing member. The lowermost portion of the sealing member then contaminates the activating shoulder with ink, which in turn contaminates the retaining groove.

The device of U.S. Pat. No. 4,711,592 further requires that the sealing member, in its downwardmost, open position be secured by frictional holding means associated with the sheath. However, such holding means have been found to malfunction when the sealing member is not carried downwardly with sufficient force by the writing mechanism, when the holding means is contaminated with ink or lubricant or when the pen is jarred. In such situations, upon upward retraction of the writing mechanism, the activating shoulder engages the lowermost portion of the sealing member, causing it to close tightly upon the writing mechanism to prevent its complete upward movement.

It is accordingly an object of the present invention to improve the pen of U.S. Pat. No. 4,711,592.

In particular, it is a further object of this invention to cause the sealing member to be downwardly urged independently of the writing member.

It is another object of the present invention to provide a pen of the aforesaid nature wherein said sealing member is held in its open position by means other than frictional restraint.

These objects and other objects and advantages of the invention will be apparent from the following description.

SUMMARY OF THE INVENTION

The present invention is adapted to be embodied in a marking pen comprising:

(a) a sheath having an upper portion, and a lower portion terminating in an open front end, (b) a writing member coaxially disposed within said sheath and having a cylindrical front portion of relatively small diameter terminating in a writing tip, and a rear portion of relatively large diameter which serves as a confining reservoir for marking fluid, and (c) actuating means associated with the sheath for causing movement of the writing member between a forwardly held writing position and a rearwardly held non-writing position.

In association with a marking pen of the aforesaid nature, the present invention is comprised of:

(d) an elastic sealing member positioned within the lower portion of said sheath and comprised of:

(1) an upper portion having a top surface radially disposed to said pen axis, and a cylindrical bore centered upon said axis and whose diameter permits close-fitting penetrative insertion by the front portion of said writing member, (2) a lower portion having two or more segments having inner and outer surfaces and adapted to move between a divergent disposition and a converged disposition adjacent said axis wherein the inner surfaces mate to form a chamber whose upper extremity communicates with said bore, and (3) an intermediate portion having recesses which permit said segments to move in hinge-like manner with respect to said upper portion, (e) a pressing shoulder inwardly directed from the lower portion of said sheath and adapted to engage the outer surfaces of said segments and thereby direct the segments to their divergent and converged dispositions, (f) an activating shoulder disposed upon the front portion of said writing member and adapted to abut against the upper extremity of said chamber, and (g) a coil spring compressively interactive between said writing member and the top surface of said sealing member, whereby, (h) when said writing member is moved downwardly within said sheath, said coil spring forces said sealing member downwardly, causing: (1) said pressing shoulder to act upon the exterior surfaces of the segments to direct the segments to their divergent disposition, (2) said segments to become held in their divergent disposition by the compressive force of said coil spring, and (3) said writing tip to protrude from the open front end of the sheath, and (i) when said writing member is moved upwardly within said sheath, said activating shoulder forces said sealing member upwardly and causing: (1) said pressing shoulder to act upon the exterior surfaces of the segments to direct the segments to their converged disposition, (2) placement of the writing tip within said chamber formed by the mated inner surface of the converged segments, and (3) sealing of the upper extremity of said chamber with the writing tip disposed therein.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
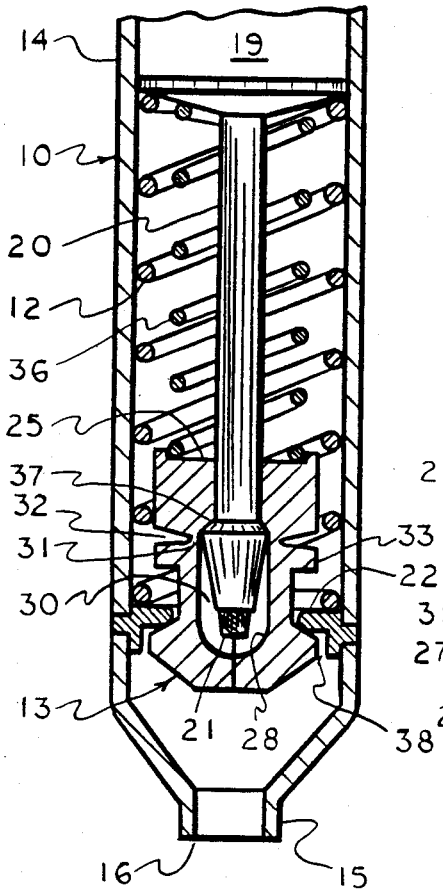
FIG. 2 is a view of the pen of FIG. 1 shown with the writing member in its retracted position.

Referring to the drawings, an embodiment of the marking pen of the present invention is shown comprised of sheath 10 having writing member 11 disposed therein, and sealing member 13 disposed within said sheath generally below said writing member. An actuating spring 12 is shown as a conventional feature of a retractable pen.

The sheath, having an elongated hollow configuration, is fabricated of a reasonably rigid material, and serves as the outer body of the pen. The sheath has an upper portion 14 and a lower portion 15 terminating in open front end 16 centered upon the longitudinal axis 17 of the pen. The inner wall 18 of the sheath is of a generally circular cylindrical configuration. In alternative embodiments, the sheath may be of shorter length which does not completely confine the writing member. Such shorter sheaths are particularly useful in wide diameter markers.

The writing member, which is coaxially centered within the sheath, is comprised of an elongated rear portion 19 of relatively large diameter which serves as a confining reservoir for marking fluid, and an elongated cylindrical front portion 20 of relatively small diameter which serves as a marking fluid conduit and terminates in writing tip 21 which may be a ball or felt.

Actuating means of conventional design (not shown) will generally be associated with the upper Portion of the sheath for causing movement of the writing member between a forwardly held writing position and a rearwardly held non-writing position.

Actuating spring 12 is interactive between a pressing shoulder 22 inwardly directed from the lower portion of the sheath, and the rear portion 19 of the writing member. In such manner of disposition, the actuating spring serves to drive the writing member to its retracted non-writing position and to hold it there. In alternative embodiments, particularly those with sheaths of shorter length, the actuating spring may not be utilized. In such embodiments, a snap fit may be configured between portions of the writing member and the sheath to hold the writing member in its writing and non-writing positions. Equivalent holding means may, however, be utilized.

Sealing member 13 is of monolithic construction, having been fabricated of an elastomer by molding or other shaping methods. The sealing member is comprised of upper portion 23 having cylindrical bore 24 centered therein and centered upon the pen axis. The diameter of bore 24 is just slightly larger than the diameter of front portion 20 of the writing member. Upper portion 23 is bounded from above by top surface 25 radially disposed to said pen axis. Alternative embodiments of the sealing member may be of non-monolithic construction, fabricated of two or more specially interactive components.

Figure 1:
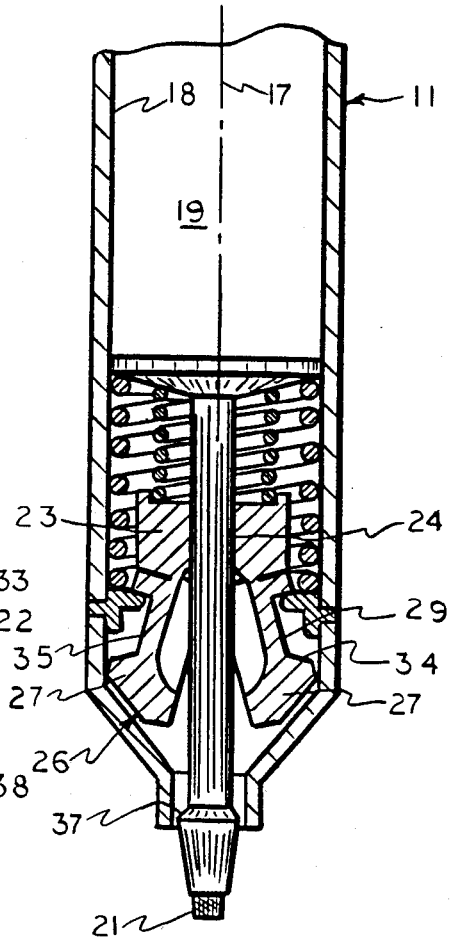
FIG. 1 is a sectional side view of an embodiment of marking pen of the present invention showing the writing member deployed in its writing position.
Figure 4:
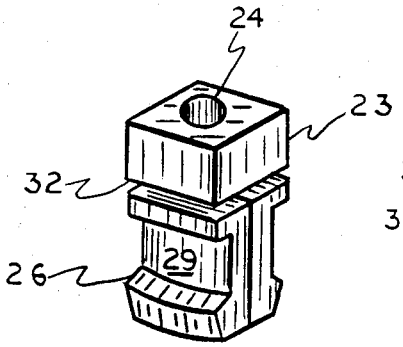
FIG. 4 is a perspective view of the sealing member of FIG. 2.
Figure 3:
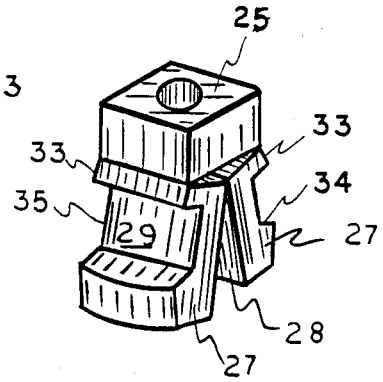
FIG. 3 is a perspective view of the sealing member of FIG. 1.

The lower portion 26 of the illustrated sealing member has two pendant segments 27 having contoured inner and outer surfaces 28 and 29, respectively. The segments are adapted to move between a divergent state shown in FIGS. 1 and 3, and a converged state shown in FIGS. 2 and 4. In the converged state, the segments are in their closest approach to the pen axis, and their inner surfaces mate to form a chamber 30 whose upper extremity communicates with said bore. In other embodiments, three or more such segments may be utilized. In still other embodiments the sealing member, by virtue of its elasticity, may be configured to allow the segments to move to their divergent state without lateral separation, thereby reducing the size of the inner surfaces which must mate to form a chamber.

The intermediate portion 31 of the sealing member has recesses 32 which permit the segments to move in hinge-like manner with respect to upper portion 23. In alternative embodiments, movement of the segments may be accomplished without such recesses.

Pressing shoulder 22 is positioned and configured to engage the outer surfaces of the segments. It is to be noted that the upper extremity of said outer surfaces has an outwardly directed abutment shoulder 33. The lower extremity has an outwardly tapered region 34. An inwardly depressed trough-like zone 35 is disposed between shoulder 33 and tapered region 34. By virtue of such configuration of the outer surfaces of the segments, and their interaction with pressing shoulder 22, the segments are directed to their divergent state when the sealing member is urged downwardly, and are directed to their coverged state upon upward movement of the sealing member. In alternative embodiments, two pressing shoulders may be positioned and configured to engage outer surfaces of the segments. In such embodiments, outer surfaces of the segments may be specially contoured to interact with said pressing shoulders such that one pressing shoulder directs the segments to their divergent state when the sealing member is urged downwardly and one pressing shoulder directs the segments to their converged state upon upward movement of the sealing member.

A restraining hip 38 protruding outwardly from tapered region 34 is positioned and configured to engage pressing shoulder 22 to prevent excessive upward movement, and consequent dislodging, of the sealing member.

Coil spring 36, compressively interactive between rear portion 19 and top surface 25, is disposed coaxially within actuating spring 12. Coil spring 36 thereby serves the functions of: (a) driving the sealing member downward and (b) holding the sealing member in its downwardly urged position.

An activating shoulder 37 is associated with the front portion of the writing member, and is adapted to abut against the interior surface of the sealing member during upward, retracting motion. Said activating shoulder thereby serves the functions of: (a) driving the sealing member upward, (b) holding the sealing member in its upwardly urged position, and (c) forming a seal against bore 24 to cause chamber 30 to become an air-tight enclosure for writing tip 21. In other embodiments, the bore and the interior surface of the sealing member may be specially shaped to seat said activating shoulder. In other such embodiments, said activating shoulder may have the additional function of assisting the coil spring in driving the sealing member downward.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a marking pen comprising:

(a) a sheath having an upper portion, and a lower portion terminating in an open front end, (b) a writing member coaxially disposed within said sheath and having a cylindrical front Portion of relatively small diameter terminating in a writing tip, and a rear portion of relatively large diameter which serves as a confining reservoir for marking fluid, and (c) actuating means associated with the sheath for causing movement of the writing member between a forwardly held writing position and a rearwardly held non-writing position, the improvement comprising: (d) an elastic sealing member positioned within the lower portion of said sheath and comprised of:

(1) an upper portion having a top surface radially disposed to said pen axis, and a cylindrical bore centered upon said axis and whose diameter permits close fitting penetrative insertion by the front portion of said writing member, (2) a lower portion having two or more segments having inner and outer surfaces and adapted to move between a divergent disposition and a converged disposition adjacent said axis wherein the inner surfaces mate to form a chamber whose upper extremity communicates with said bore, and (3) an intermediate portion having recesses which permit said segments to move in hinge-like manner with respect to said upper portion, (e) a pressing shoulder inwardly directed from the lower portion of said sheath and adapted to engage the outer surfaces of said segments and thereby direct the segments to their divergent and converged dispositions, (f) an activating shoulder disposed upon the front portion of said writing member and adapted to abut upwardly against the upper extremity of said chamber, and (g) a coil spring compressively interactive between said writing member and the top surface of said sealing member, whereby, (h) when said writing member is moved downwardly within said sheath, said coil spring forces said sealing member downwardly, causing; (1) said pressing shoulder to act upon the exterior surfaces of the segments to direct the segments to their divergent disposition, (2) said segments to become held in their divergent disposition by the compressive force of said coil spring, and (3) said writing tip to protrude from the open front end of the sheath, and (i) when said writing member is moved upwardly within said sheath, said activating shoulder forces said sealing member upwardly and causing: (1) said pressing shoulder to act upon the exterior surfaces of the segments to direct the segments to their converged disposition, (2) placement of the writing tip within said chamber formed by the mated inner surface of the converged segments, and (3) sealing of the upper extremity of said chamber with the writing tip disposed therein.

2. The improvement of claim 1 wherein the upper extremity of the outer surface of said segments has an outwardly directed abutment shoulder, and the lower extremity of said outer surface has an outwardly tapered region.

3. The improvement of claim 2 wherein an inwardly directed trough-like zone is disposed between said abutment shoulder and tapered region.

* * * * *